US006588410B1

(12) United States Patent
Graber

(10) Patent No.: US 6,588,410 B1
(45) Date of Patent: Jul. 8, 2003

(54) TARGET THROWER

(76) Inventor: Delmar D. Graber, 3066 Franklin Rd., Russellville, KY (US) 42276

( * ) Notice: Subject to any disclaimer, the term of this patent is extended or adjusted under 35 U.S.C. 154(b) by 24 days.

(21) Appl. No.: 10/047,595

(22) Filed: Jan. 14, 2002

Related U.S. Application Data

(60) Provisional application No. 60/266,364, filed on Feb. 2, 2001.

(51) Int. Cl.[7] ..... F41J 9/18
(52) U.S. Cl. ..... 124/8
(58) Field of Search ..... 124/8

(56) References Cited

U.S. PATENT DOCUMENTS 5,249,563 A * 10/1993 Patenaude ..... 124/8
5,406,928 A * 4/1995 Panara et al. ..... 124/8
5,937,839 A * 8/1999 Nilsson et al. ..... 124/8
6,176,229 B1 * 1/2001 Patenaude ..... 124/8
6,431,161 B1 * 8/2002 Gustafsson ..... 124/8

* cited by examiner

*Primary Examiner*—John A. Ricci
(74) *Attorney, Agent, or Firm*—George H. Morgan; Mark Manley

(57) ABSTRACT

A target thrower comprising a target turret assembly; a ratcheting assembly; a target positioning component assembly further comprising spring loaded stabilizing fingers, a target lowering assembly and temporary support fingers; and a target launching asssembly further comprising a target launching arm. A target is dropped from the target turret assembly onto a target lowering assembly that lowers the target in position for engagement by the target launching arm that launches the target.

6 Claims, 19 Drawing Sheets

1

TARGET THROWER

CROSS REFERENCES TO RELATED APPLICATIONS

Provisional Application for Patent No. 60/266,364 of Feb. 2, 2001 with the same title, "Target Thrower", which is hereby incorporated by reference. Applicant claims priority pursuant to 35 U.S.C. Par. 119(e)(i).

Statement as to rights to inventions made under Federally-sponsored research and development: Not applicable

BACKGROUND OF THE INVENTION

1. Field of the Invention

The present invention is an apparatus that throws targets such as are used by skeet and trap shooters. The apparatus holds as supply of targets which are automatically fed to a throwing arm, eliminating the need for a person to manually load each target as it is required by the target thrower.

2. Description of Prior Art

Existing prior art includes:

| | | |
|---|---|---|
| 2,677,361 | McIntire | May 4, 1954 |
| 3,070,082 | Foster | Dec. 25, 1962 |
| GB2189154A | Lawrence | Apr. 15, 1986 |
| 4,706,641 | Cote et al | Nov. 17, 1987 |
| 5,036,828 | Heffer | Aug. 6, 1991 |
| 5,249,563 | Patenaude | Oct. 5, 1993 |
| 5,937,839 | Nilsson et al. | Aug. 17, 1999 |

Currently, both manually loaded and automatically loaded target throwers are used.

However, due to differences in flight patterns of double thrown targets from the automatically loaded target throwers, competition shooters prefer the manually loaded target throwers.

Manually loaded target throwers typically one person loads each clay target, as required, and a second person actuates an electrical switch to fire the target thrower. The problem with this is that the person actuating the target thrower firing mechanism didn't know for sure if there was a target properly loaded in target thrower. This could disappoint the shooter who was waiting for a target to be thrown. In competitions, this is unacceptable. Even more unacceptable, is if the target loader had his hands injured because his hands were in the way of the firing mechansim when the target thrower was actuated by the person actuating the electrical switch. While a properly trained loader should not have a hand or finger caught in the firing mechanism, it happens. While automatic target throwers, which eliminate the need for manual loading exist, they are complicated as compared to the present invention.

Targets thrown in pairs by the manually loaded machines are thrown in a tighter flight pattern than are those targets thrown in pairs by the automatically loaded machines. The difference is significant enough, that in trap shoot meets, the contestants try to get signed up for the manually loaded machines, if there is a choice between of machines. Some have been known to decline to compete if they had to shoot at targets thrown from the automatically loaded target throwing machines. For a shooter new to the sport, it is not a major consideration, usually. However, the very experienced target shooters who grew up with the manually loaded target throwing machines, it usually is a major problem for them in competition shooting. Also, existing automatically loaded target throwing machines index only in one direction, typically counterclockwise as you are looking at the top of the machine.

Targets are loaded into a magazine in such existing automatically loaded target throwing machines. There is no simple way to counter rotate said magazine should there be a problem, such as a broken target, where it would be desirable to get a certain section of the magazine in position so someone could remedy the problem.

Accurate placement of targets on launching arms seems to be a basic problem of existing automatically loaded target throwing machines. Targets launched from machines with automatic loading devices that drop a target from a magazine of targets, directly onto a launching arm, seem to have the variations in flight patterns that are objectionable to shooters.

Nisson, U.S. Pat. No. 5,937,839, for example, lacks a controlled way in which a target is handled from a magazine of targets to the launch arm. This would seem to cause variations in flight patterns that would be objectional to shooters.

As will be seen in the subsequent description of the preferred embodiments of the present invention, the present invention overcomes these and other deficiencies of existing technology.

SUMMARY OF THE INVENTION

The present invention is an apparatus, that enables one person to both load and operate the target thrower as opposed to having an operator plus a loader. A rotary indexing carousel assembly, releases one or two targets as desired by an operator, through one or two target dispensing apertures that permits a target to fall through each of said aperetures by its own weight onto a target lowering assembly that is pulled downward. As the target lowering assembly is pulled downward, one or two, as desired, targets are deposited on temporary support fingers and stabilizing fingers. The target lowering assembly continues to move downward, out of the way.

As these actions are occurring, a target throwing arm is being rotated into position to launch a target. The arm continues to rotate until it is stopped and held in postion by a stop. The arm moves under the one or two targets, pushes down the support fingers. The arm supports the one or two targets which are then ready to be thrown.

A brake assembly serves to provide a braking action on the arm as the arm is rotating into position to load a new target. Targets are launched by a release rotating the stop out of the way. The target throwing arm then rotates rapidly, launching the one or two targets.

The present invention .has the flight patterns of targets thrown from existing target throwers. This is important to many competition trap shooters when target pairs are thrown. Target pairs thrown by existing manually loaded target throwers have a different flight pattern that the flight pattern of target pairs thrown by existing automatically loaded target throwers. The rotary indexing carousel assembly can be conveniently rotated in either direction as opposed to having to be indexed under power in only one direction as is the case with present technology.

DESCRIPTION OF THE PREFERRED EMBODIMENTS

Figure 1:
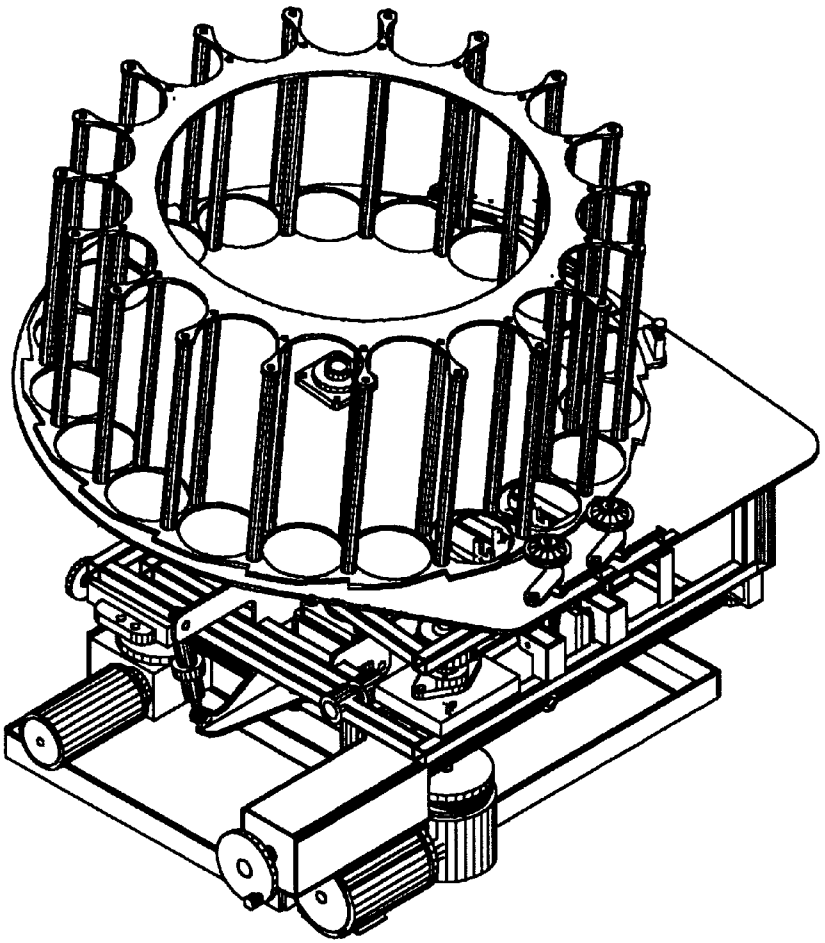
FIG. 1 shows the present invention, a target thrower.

FIG. 1 shows the preferred embodiment of the present invention, a target thrower 1, which is an apparatus for throwing targets, some of which are called clay pigeons, for sportsmen to shoot.

Referring to FIGS. 1 through 4, the target thrower 1 comprises a bearing 2, a targets guide 3, a target base 4, a base plate 5 with a target dispensing area 7, a sliding door 6, a ratcheting assembly 8, an upper frame structure 9, a ratchet linkage 10, and a target positioning component assembly 11.

Figure 3:
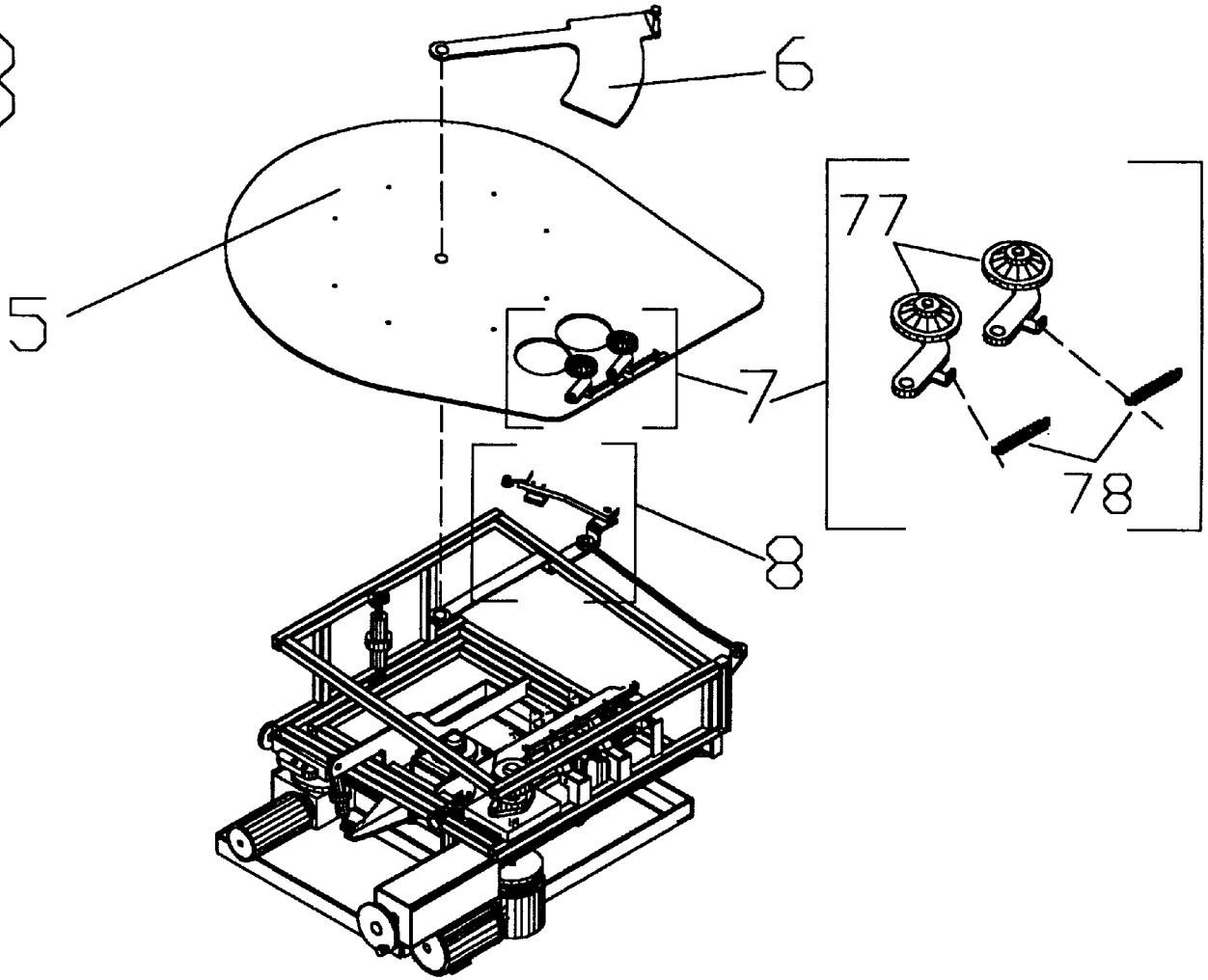
FIG. 3 is a partially exploded view of target thrower parts comprising the base plae, a sliding door, target dispensing details, and a ratcheting assembly.
Figure 4:
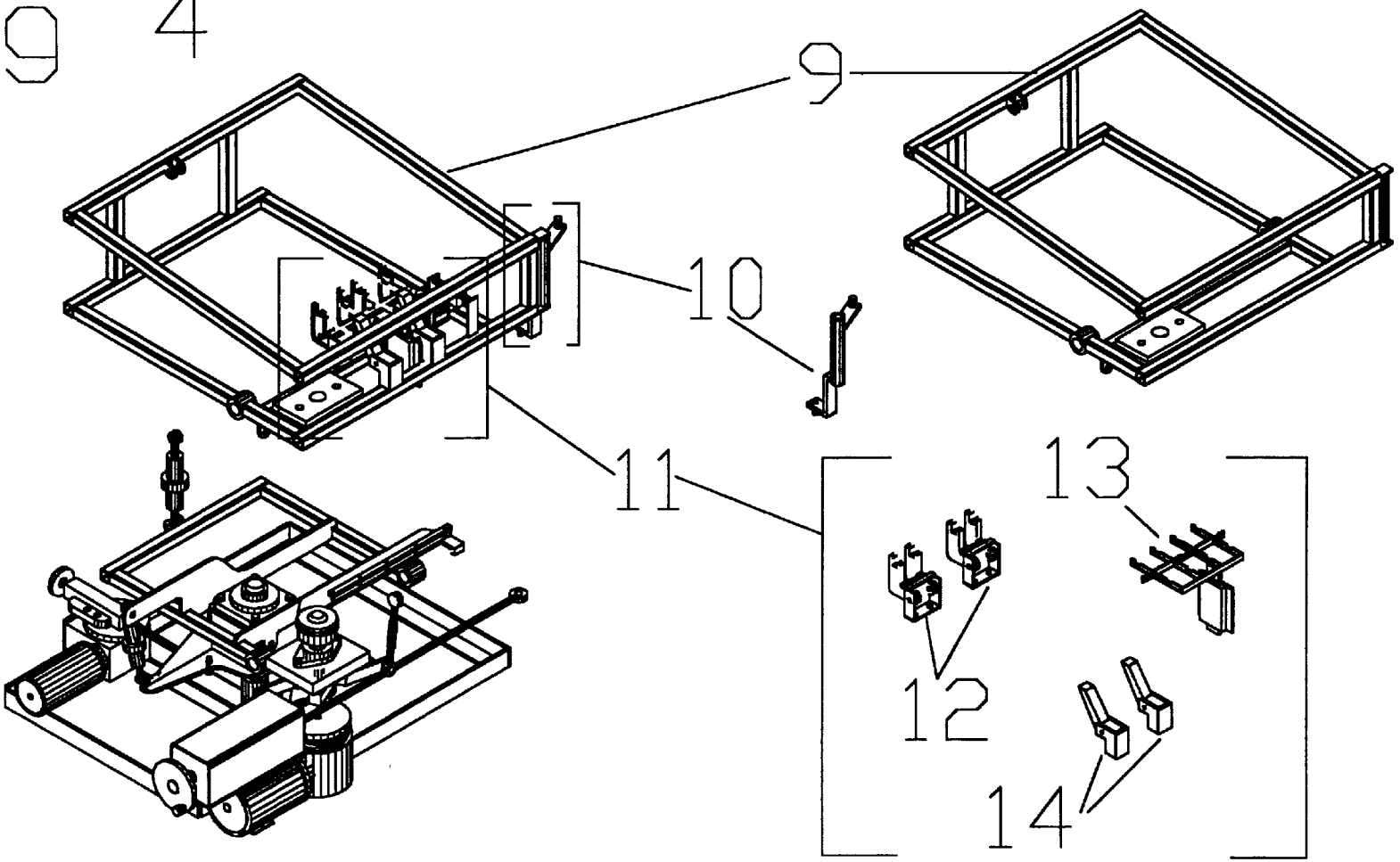
FIG. 4 illustrates an upper frame structure with target positioning components.

In FIG. 3, in the target dispensing area 7, is shown spring 78 loaded wheel assemblies 77. The spring 78 loaded wheel assemblies are also shown in FIGS. 11 through 15, As shown in FIG. 4, the target positioning component assembly 11 comprises spring loaded stabilizing fingers 12, a target lowering assembly 13, and temporary support fingers 14.

Referring to FIGS. 1, 5, 6, and 19, the target thrower 1 further comprises a target launching assembly 15 which comprises a target launching arm 16, an upper arm support bearing 17, a friction plate assembly 18, a lower arm support bearing 19, a connecting shaft 20, a launching force adjustment knob 21, stop mountings 22, an arm position stop 23, and an actuator 24 which serves as a means to rotate the arm position stop 23 as required to release said arm 16.

Figure 5:
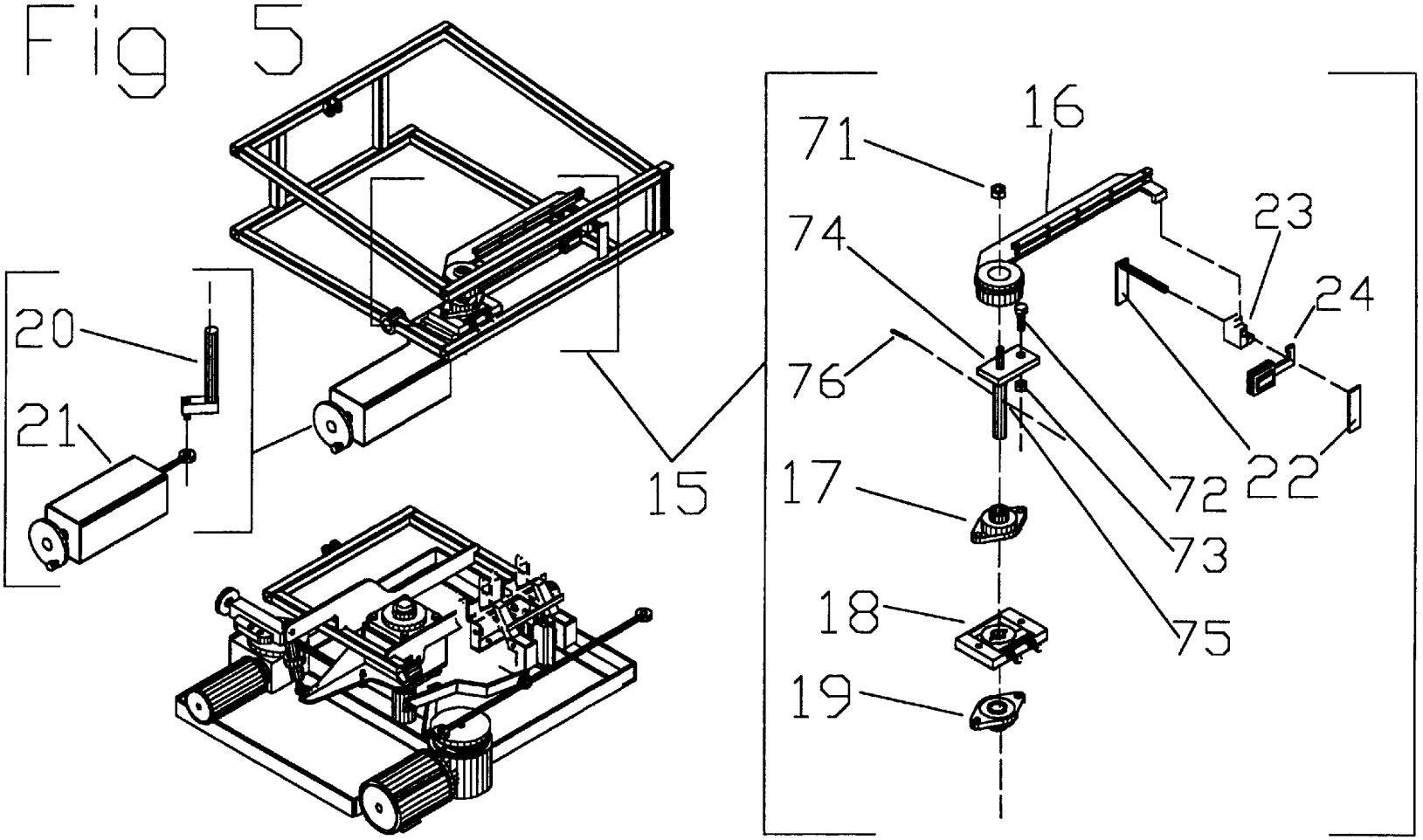
FIG. 5 illustrates a target launching assembly.
Figure 6:
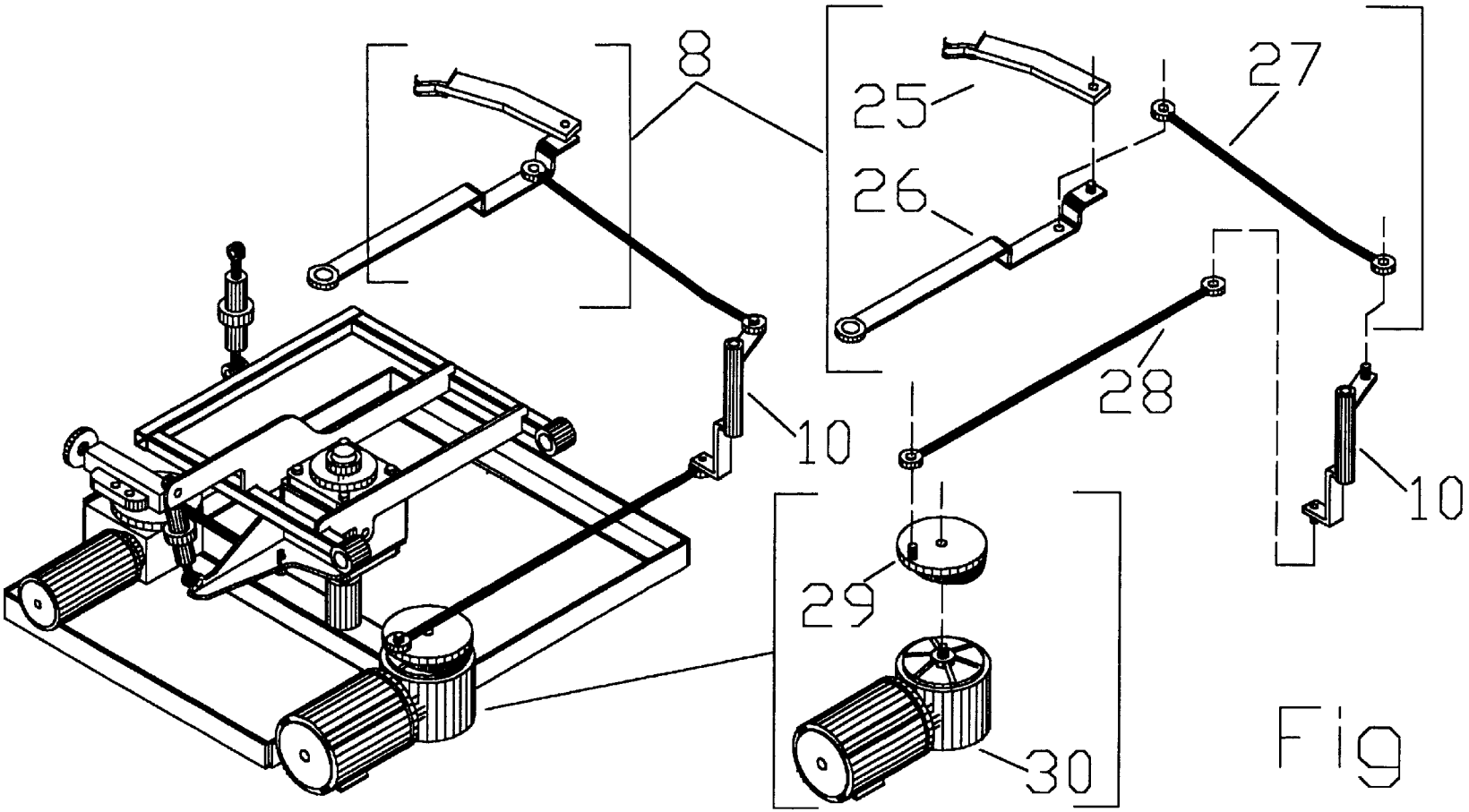
FIG. 6 illustrates the ratcheting assembly that rotates the turret base.
Figure 19:
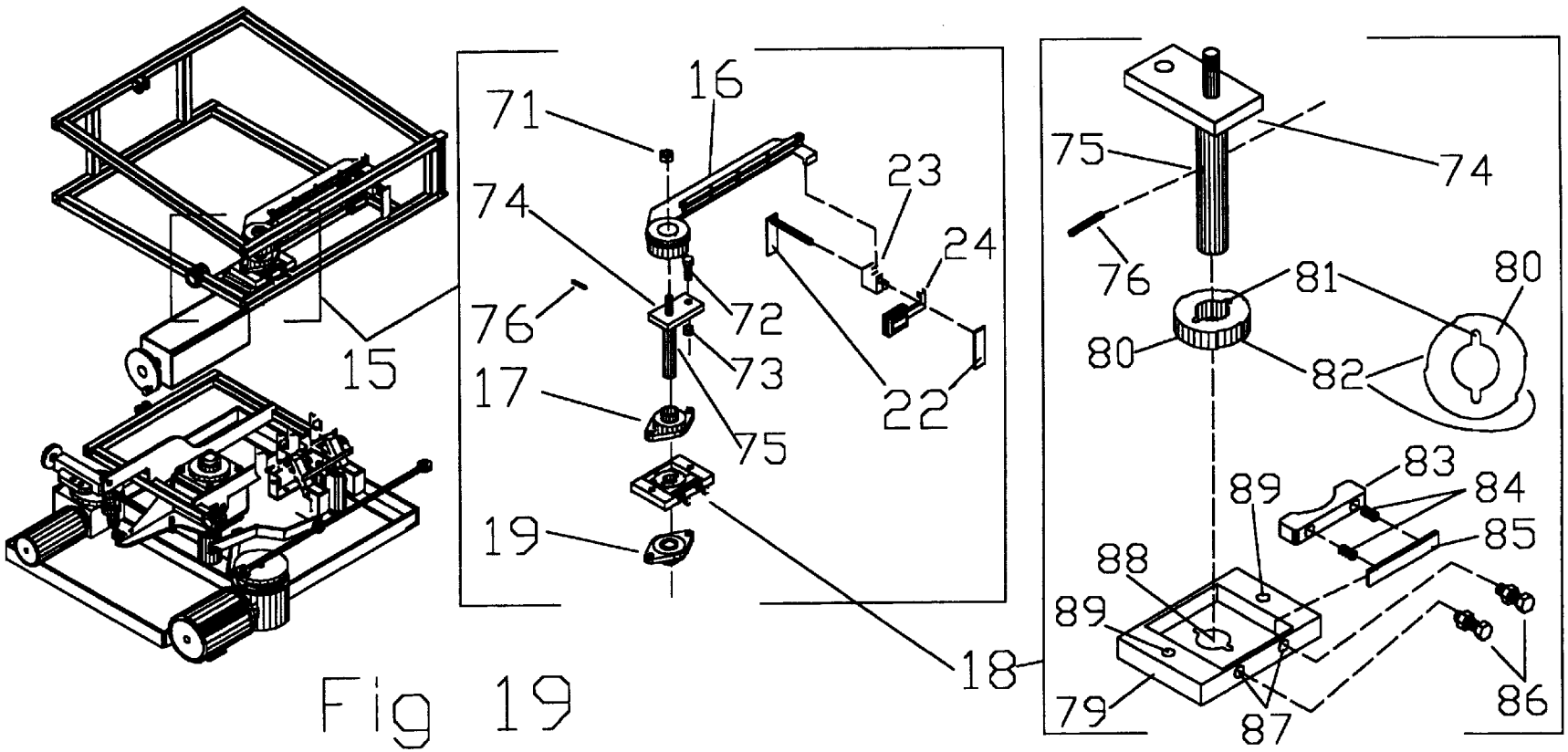
FIG. 19 illustrates a braking device.

As indicated in FIGS. 5, 6, and 19, the target launching assembly 15 further comprises a nut 71 attaching the target launching arm 16 to a braking shaft assembly 74 and a secondary bolt 72 and a secondary nut 73 that attach the target launching arm 16 to the braking shaft assembly 74, said shaft assembly comprising a pin clearance 75 that permits insertion of a pin 76, said pin 76 aligning with slots 81 in a brake disc 80 which is a component of the friction plate assembly 18.

As shown in FIG. 19, the friction plate assembly 18 comprises the brake disc 80, a brake housing 79, a brake shoe 83, springs 84, a backing plate 85, and adjustment bolt assemblies 86.

The brake disc 80 comprises the slots 81 and brake shoe clearances 82.

The brake shoe clearances 82 serve as a means of brake force variation over the cycle of rotation of the target launching arm 16. During the part of the rotation of said arm 16 where little or no braking is required, the clearances 82 are a means of providing for a desired amount of brake friction reduction.

The brake housing 79 further comprises adjustment bolt threaded apertures 87, brake shaft assembly clearance 88, and shaft clearance bearing mount apertures 89.

The adjustment bolt assemblies 86 serve as a means of adjusting springs 84 force against the brake shoe 83, which serves as a means of adjusting brake shoe 83 force against the brake disc 80, which in turn governs the maximum braking of the target launching arm 16.

Referring to FIG. 6, the ratcheting assembly 8 comprises a push arm 25, a push linkage arm 26, and a linkage 27.

The target thrower 1 of FIG. 1 also comprises a wheel linkage 28, a rotating cam wheel 29, and an electric drive 30 which are shown in FIG. 6.

Figure 7:
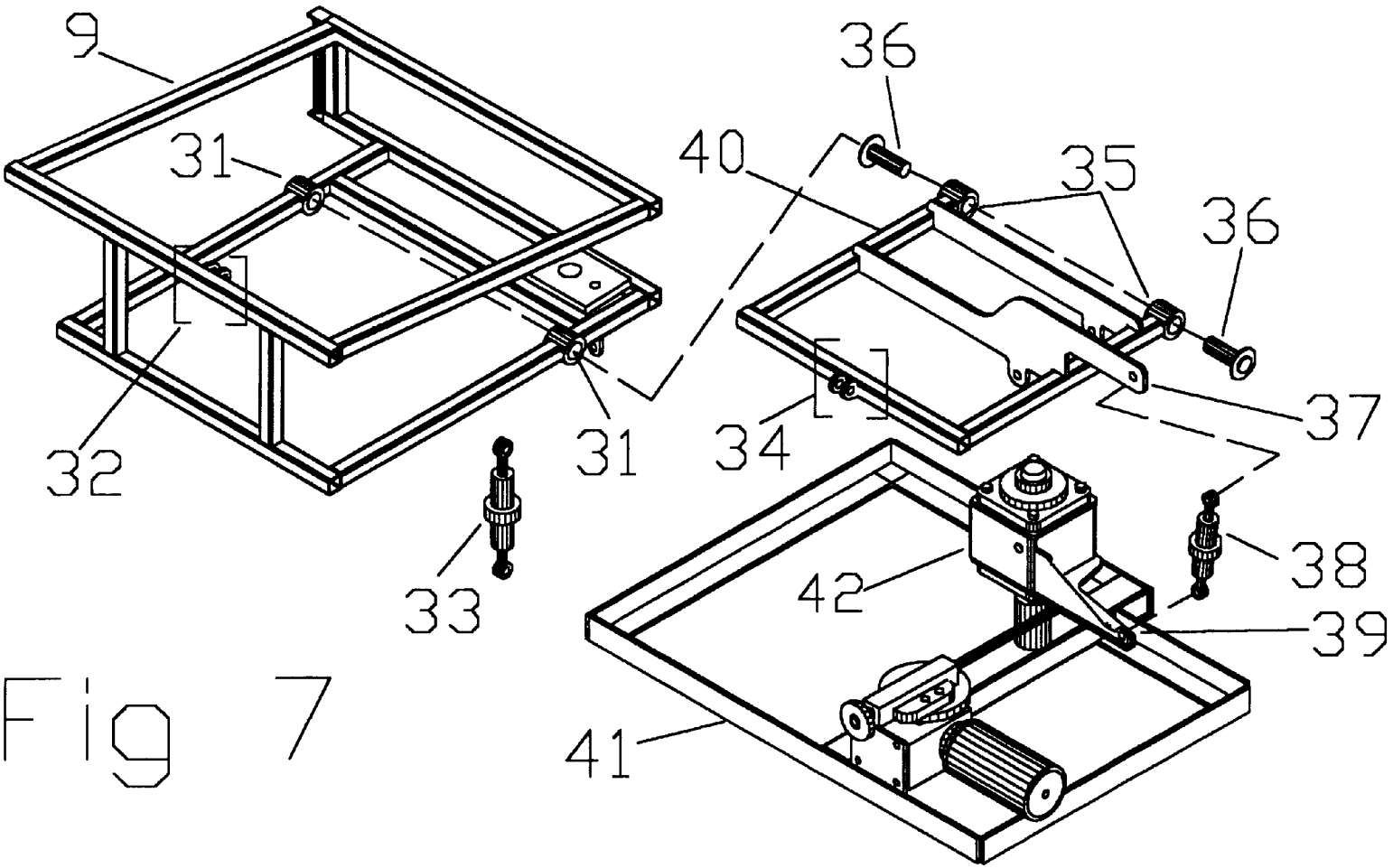
FIG. 7 illustrates the upper frame structure with a lower framework and a launcher base.
Figure 8:
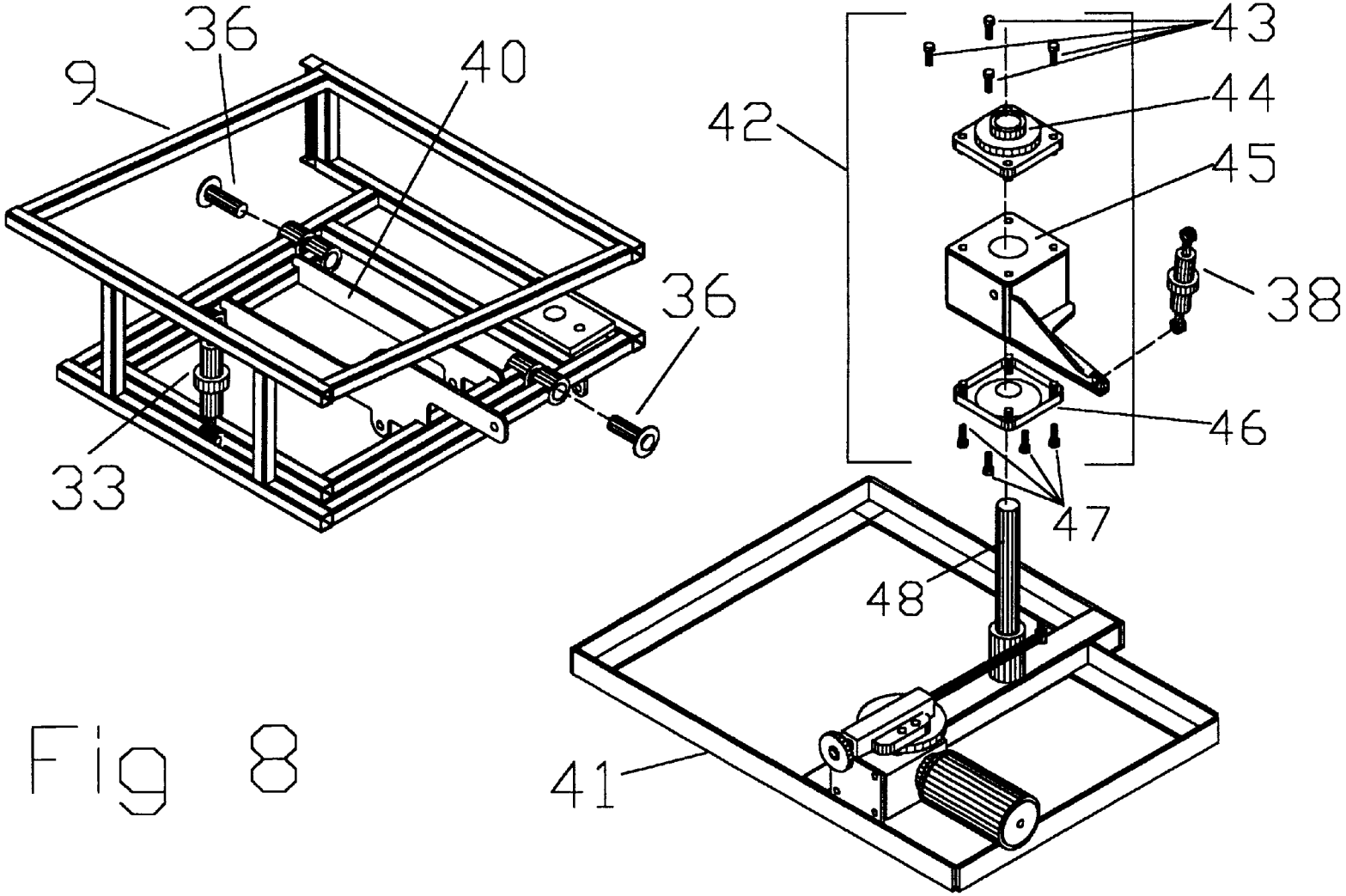
FIG. 8 illustrates a pivot assembly with the launcher base which mates up with the upper frame structure and the lower framework.
Figure 9:
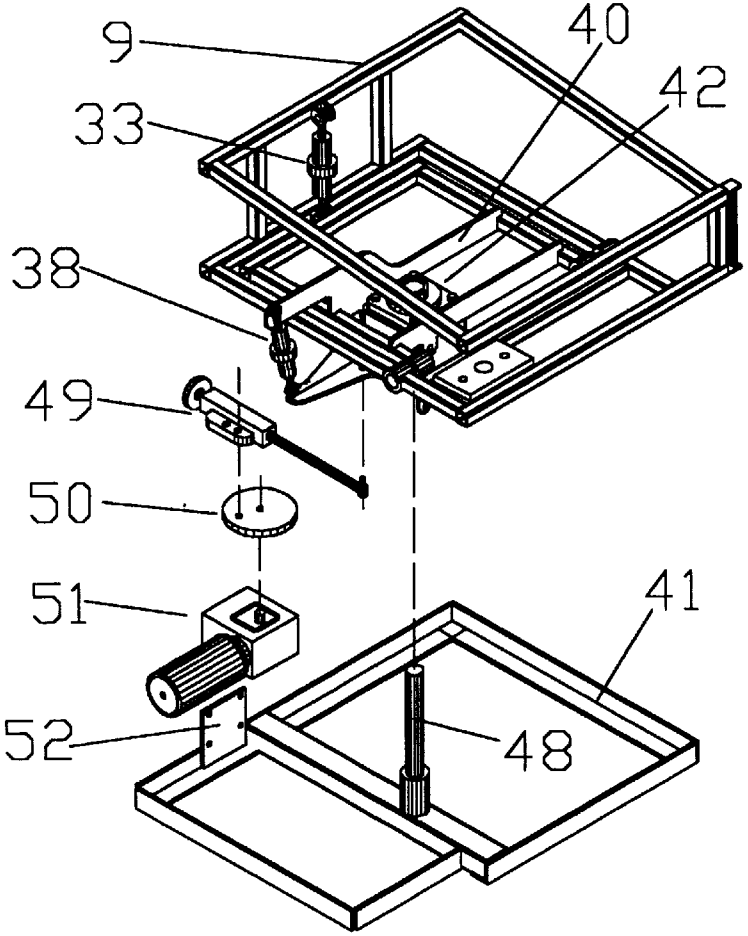
FIG. 9 is an exploded view of the lower framework.

The target thrower 1 shown in FIG. 1 further comprises, referring to FIGS. 7, 8, and 9, a departure angle adjuster 33, pivot pins 36, an elevation adjuster 38, a launcher base 41, a pivot assembly 42, a spindle 48, an oscillation adjustment linkage 49, a rotating wheel linkage 50, and an oscillating motion motor.

As shown in FIG. 7, the upper frame structure 9 further comprises upper frame pivot mounts 31 and adjuster top mount tabs 32.

As shown in FIG. 7, the target thrower 1 shown in FIG. 1 further comprises a lower framework 40 that comprises bottom mount tabs 34, lower framework pivot mounts 35, and an upper elevation adjuster mount 37.

As shown in FIG. 8, the pivot assembly 42 comprises main bearing bolts 43, an upper main pivot bearing 44, a pivot assembly mounting structure 45, and a lower main pivot bearing 46.

As shown in FIG. 9, the launcher base 41 comprises a motor mounting tab 52.

Figure 2:
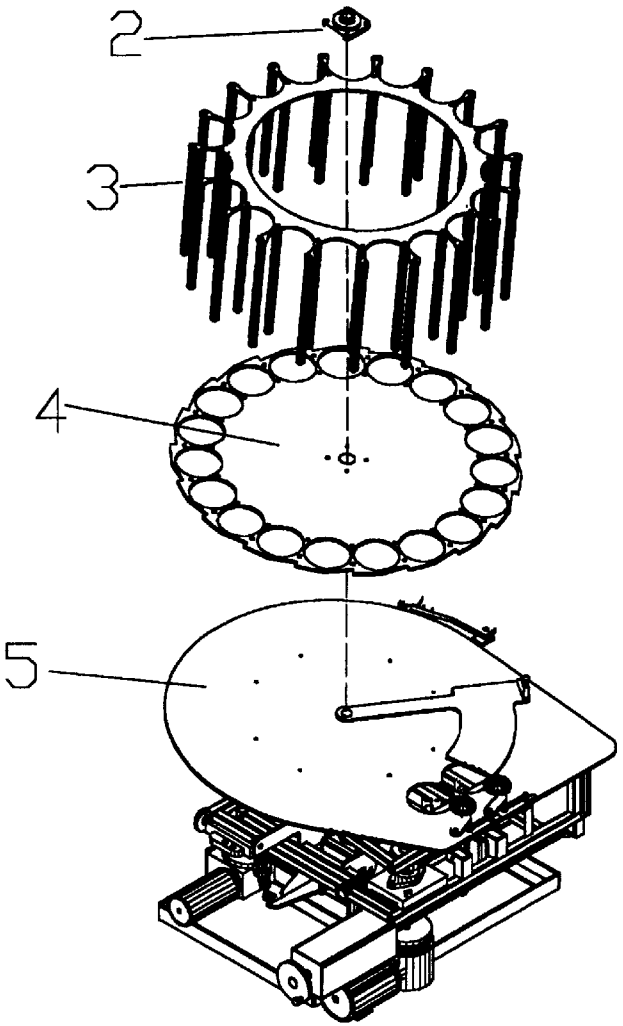
FIG. 2 is a partially exploded view of the target thrower showing a bearing, a targets guide, a turret base, and a base plate.
Figure 10:
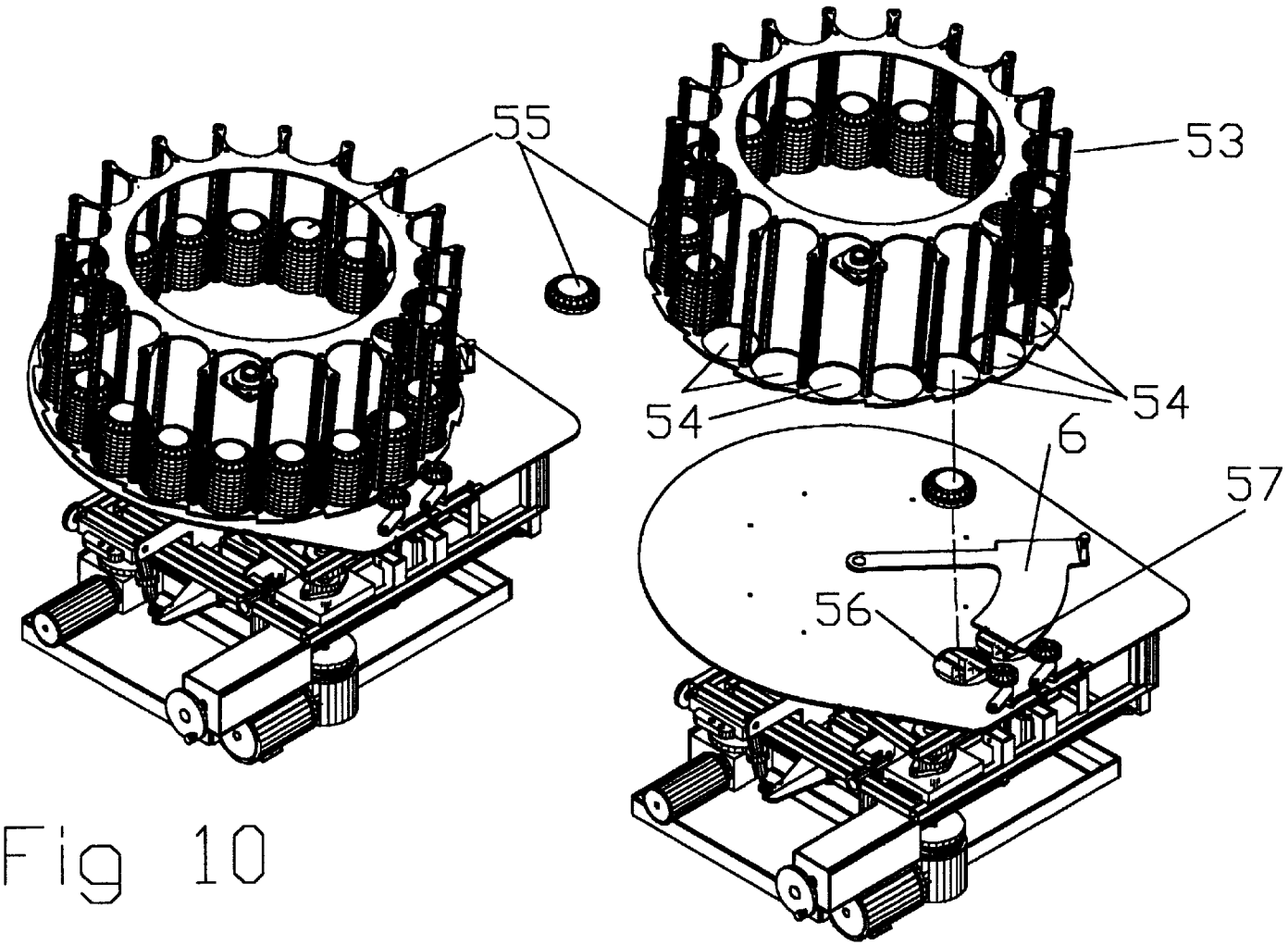
FIG. 10 illustrates the target thrower with targets.

The target feeder 1 of FIG. 1 is further illustrated in FIG. 10 as comprising a target turret assembly 53 which is further comprised of the targets guide 3 and the turret base 4 (Ref. FIG. 2). The turret base 4 is comprised of target clearances 54. FIG. 10 also shows targets 55.

The base plate 5 of FIG. 2 is shown with a first target dispensing aperture 56 and a second target dispensing aperture 57 in FIG. 10, along with the sliding door 6.

Referring to FIGS. 5 and 11 through 18, the target feeder 1 of FIG. 1 is further illustrated as comprising the fingers 12, a target lowering assembly 13, a mounting stop 22, an arm stop 23, a stop rotator 24, an arm pivot point 59, a pull down arm 60, roller bearings 61, a cam lobe 62 on cam wheel 29, a target lowering assembly pull down linkage 63, a spring 64, and a slide guide 65.

HOW THE MACHINE OPERATES

Figure 16:
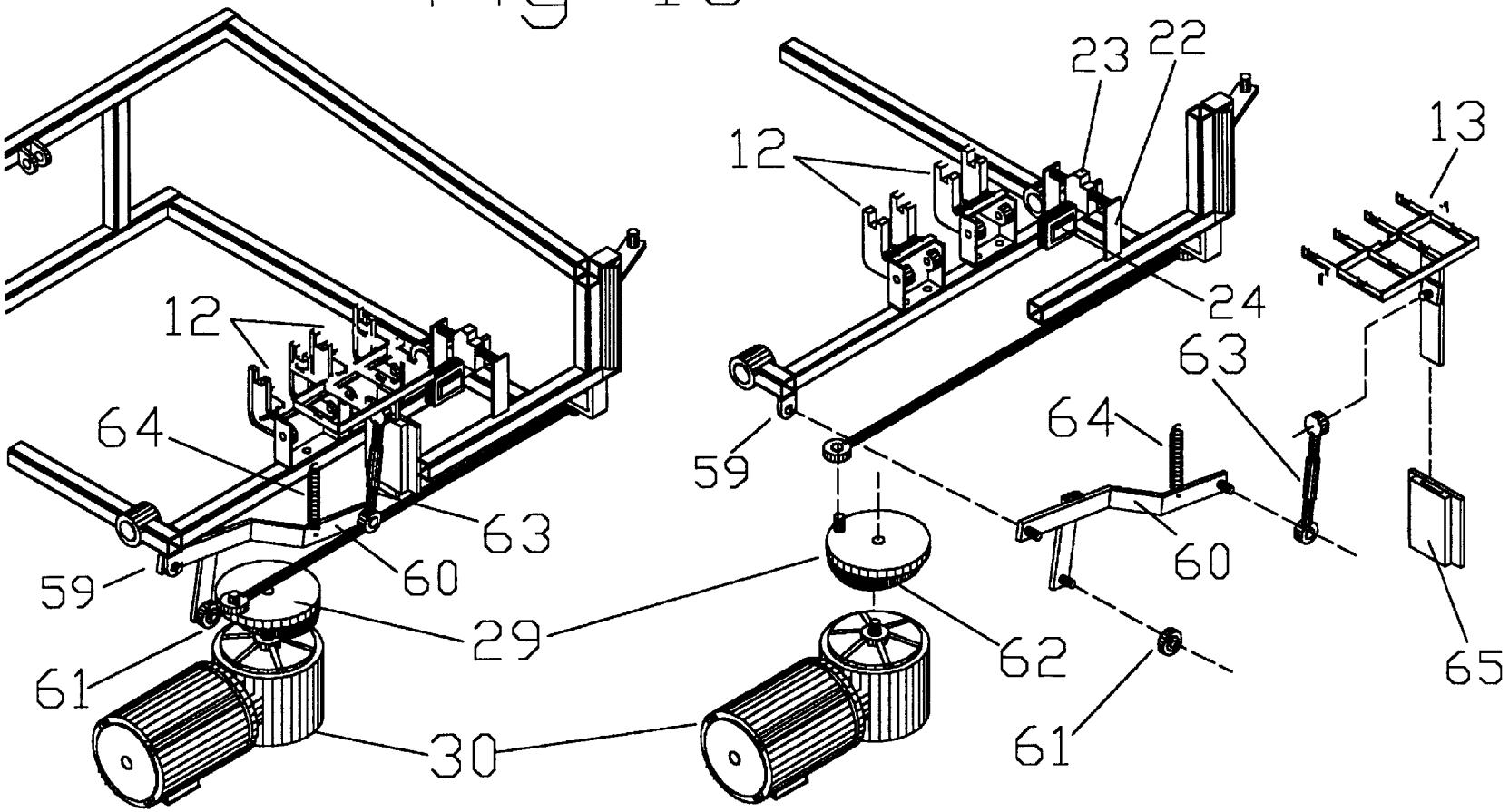
FIGS. 16, 17, and 18 illustrate launching arm details.
Figure 17:
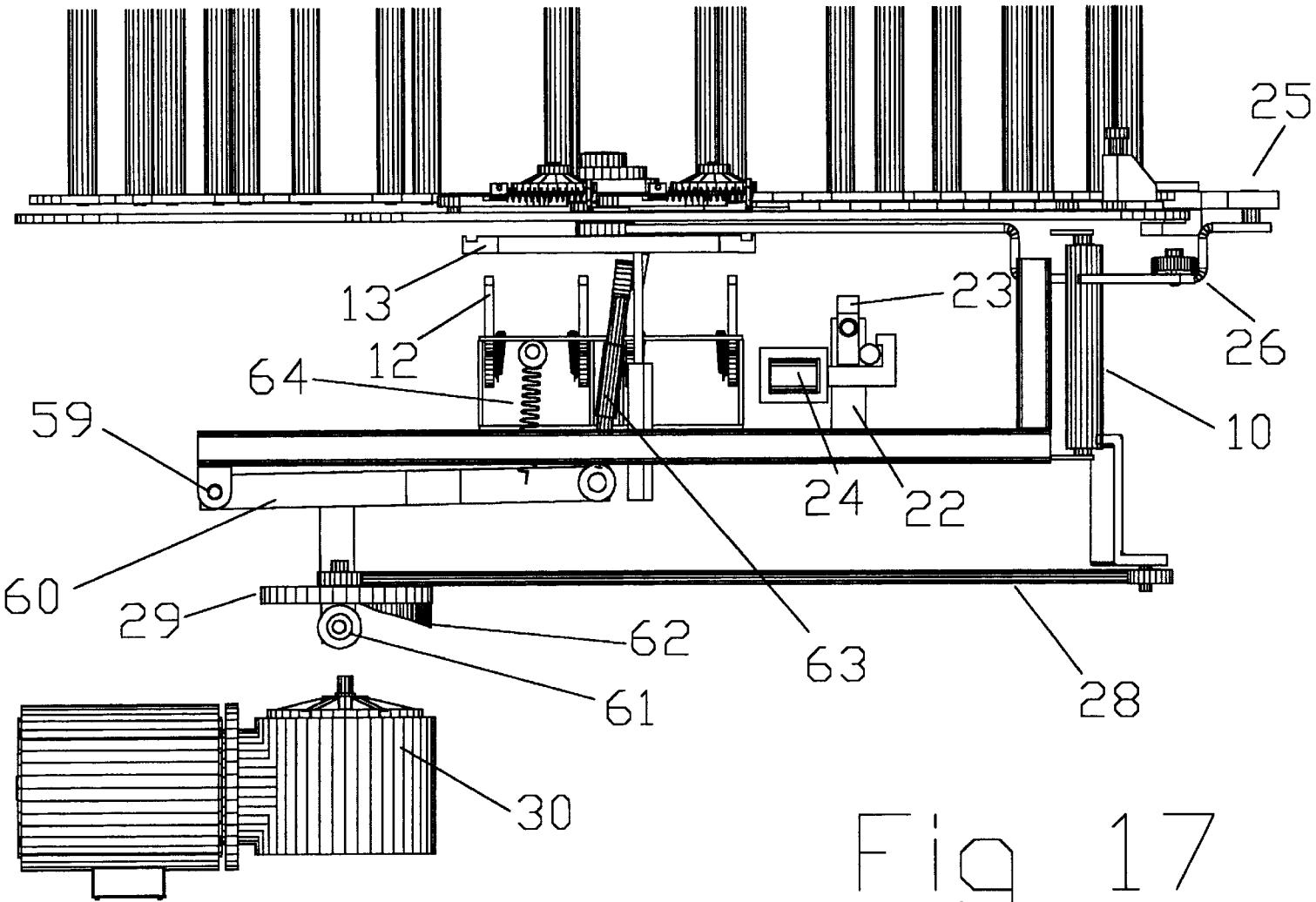
Figure 18:
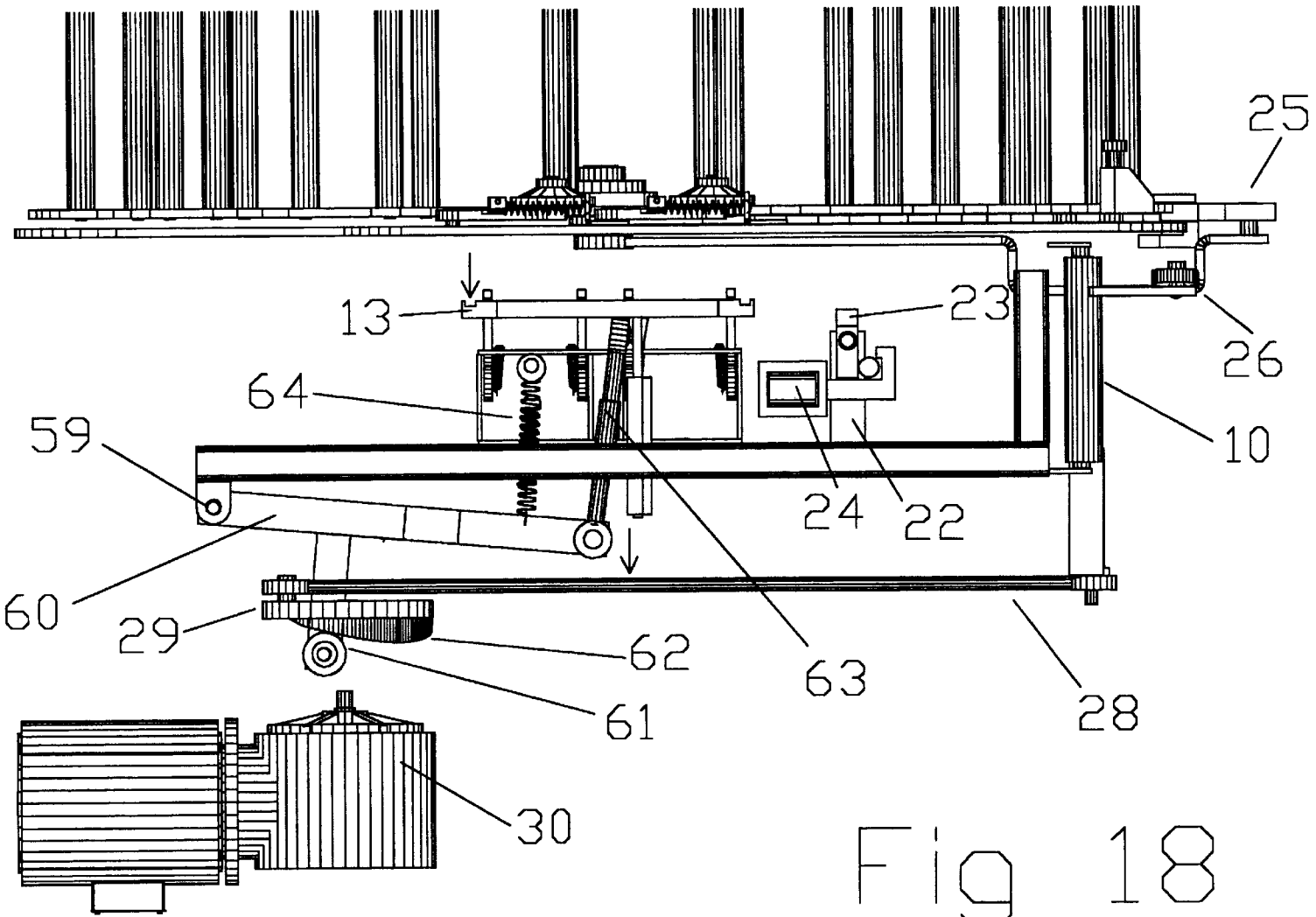

Referring to FIGS. 10, 16, and 17, a cycle begins when the motor assembly 30 rotates the cam wheel 29 through one 360 degree movement. Said linkages 28, 10, 27, and said arm 26 push the ratchet arm 25, which in turn rotates the turret assembly 53. As the turret assembly 53 rotates over the base 5 and a hole in turret 53 aligns with the hole 56 in the base plate 5, only a single target 55 will drop on to the target lowering assembly 13.

Only a single target 55 drops because the spring 78 loaded wheel assembly 77 is biased by the spring 78 against a target 55 that was resting on the target 55 being dropped, said target 55 that was resting on said target 55 being dropped, being sufficently engaged by said spring 78 loaded wheel assembly 77, that only a single target 55 is dropped on to the target lowering assembly 13.

The target lowering assembly 13 will be in the up position at this time. As the cam wheel 29 rotates, the roller 61 that is mounted on the arm 60 will roll on to the cam 62 which is machined into the bottom of the cam wheel 29. This results in the downward movement of the arm 60 that pulls down said linkage 63. Said linkage 63 in turn pulls down the target lowering assembly 13. The target lowering assembly 13 is only held up by the tension on spring 64.

Figure 11:
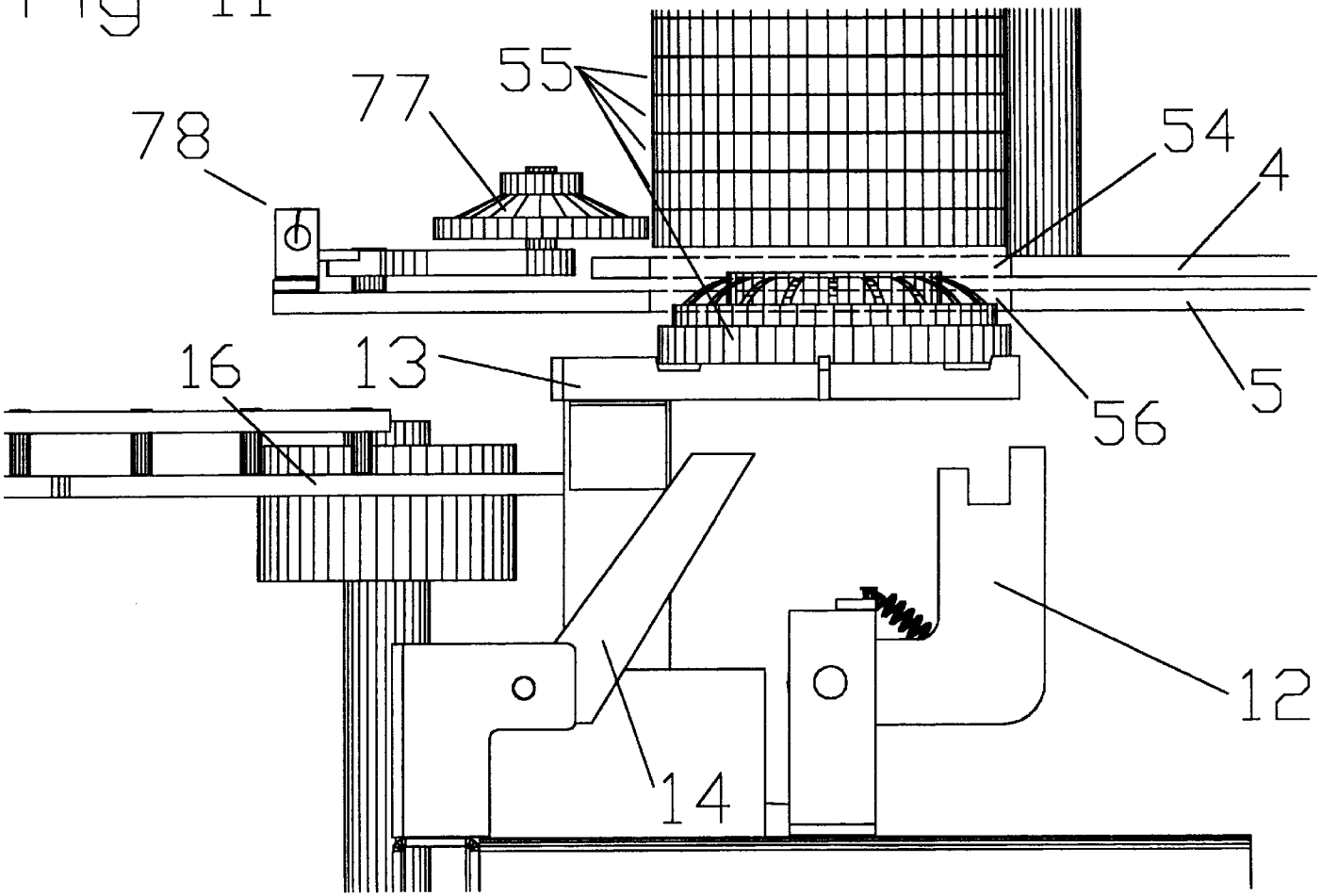
FIGS. 11, 12, and 13 illustrate a target being transferred to a target launching arm.
Figure 12:
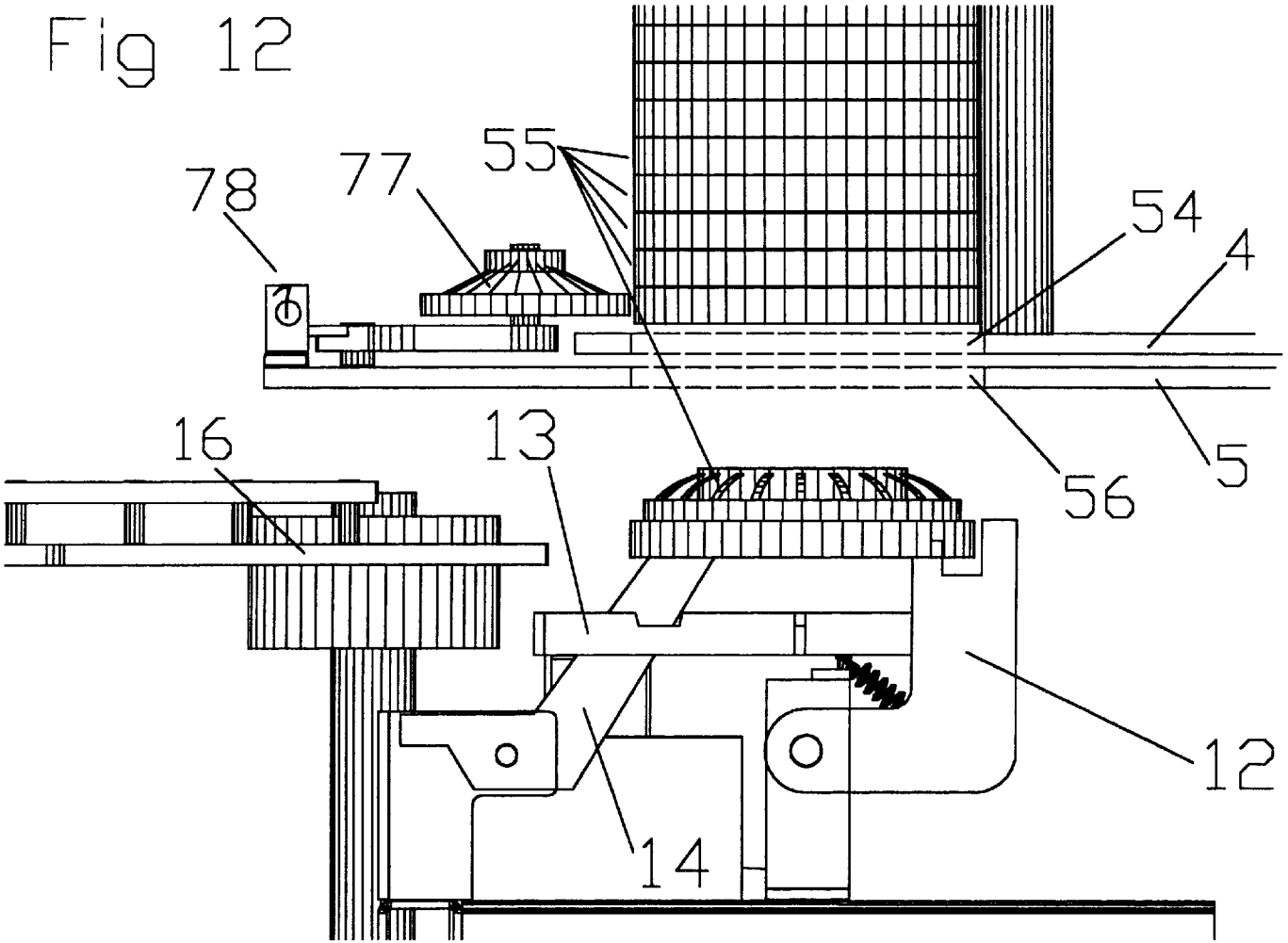

Referring to FIGS. 11 and 12, as the target lowering assembly 13 moves downward, the target 55 is deposited on the temporary support fingers 14 and the stabilizing fingers 12. The target lowering assembly 13 continues to move downward, out of the way.

As these actions are occurring, the target throwing arm 16 is also being rotated into position to launch a target 55. Said arm 16 will continue to rotate until it is stopped, and held in position by, the friction plate assembly 18. Said stop 23 can serve either as an alternative to, or supplement, said friction plate assembly 18 in that said stop 23 serves as a means to stop, and hold in position, said arm 16 as does the friction plate assembly 18.

Figure 13:
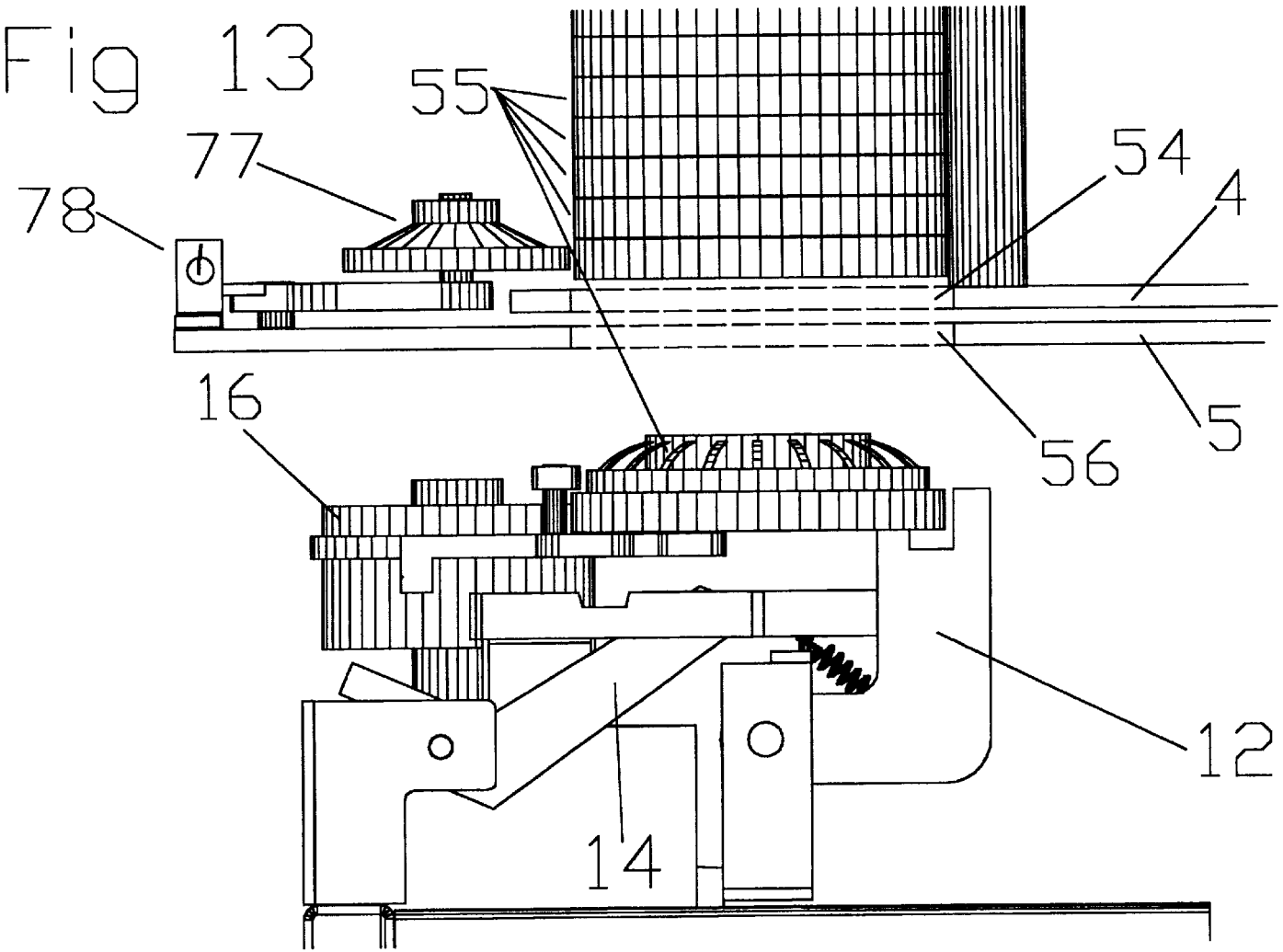
Figure 14:
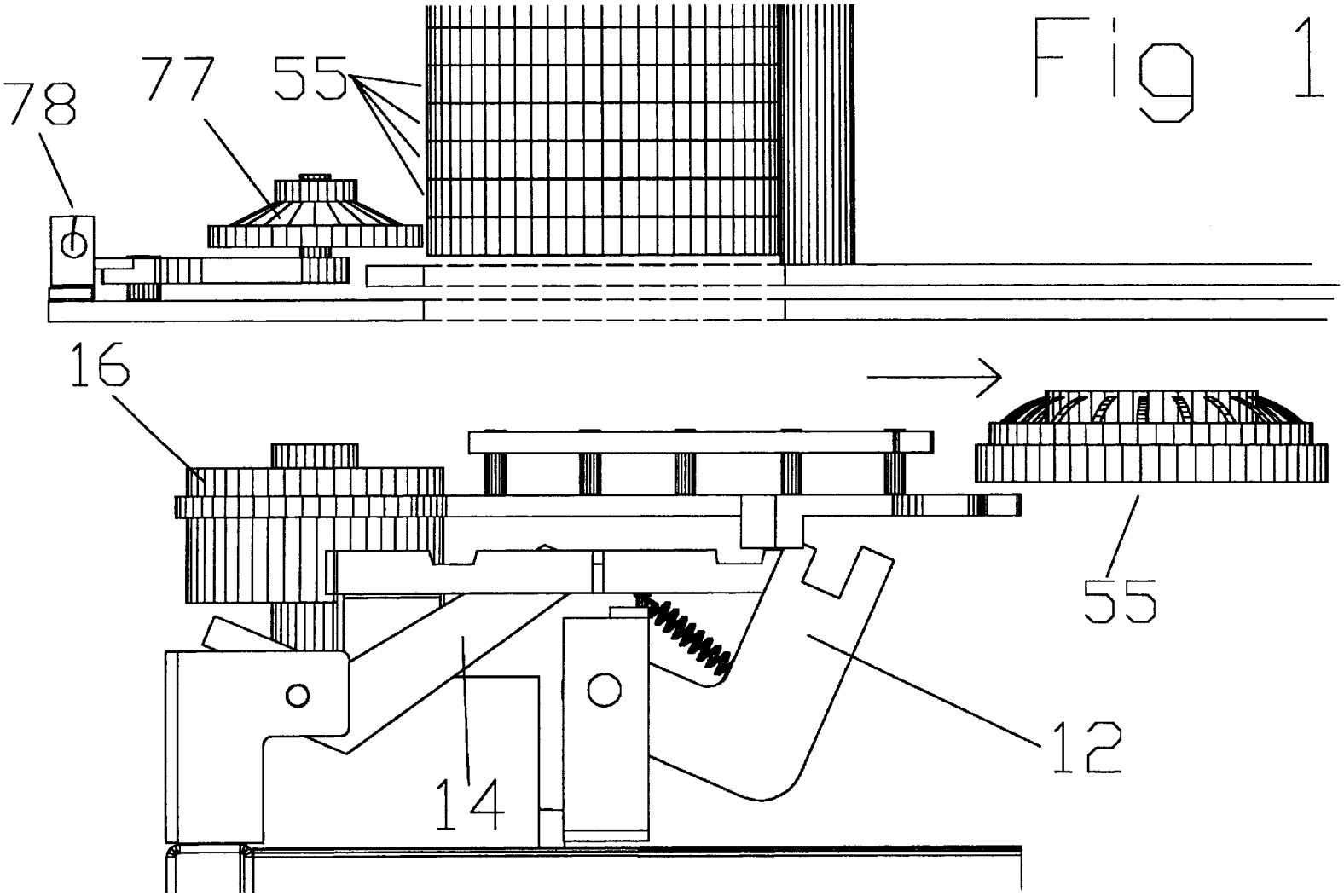
FIG. 14 illustrates a target being launched.
Figure 15:
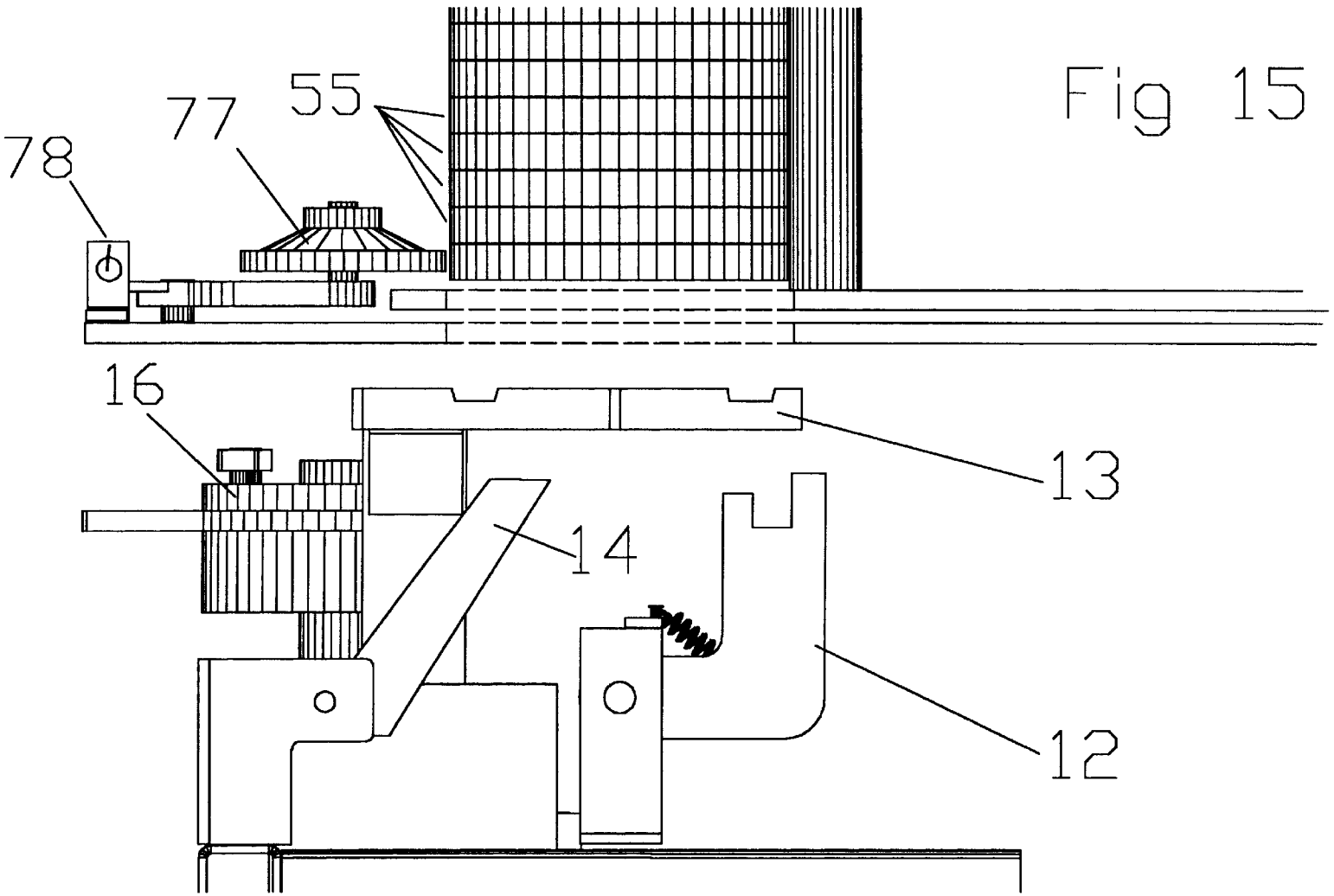
FIG. 15 illustrates a target lowering assembly in position to receive another target.

As said arm 16 moves under the target 55, said arm 16 pushes down the support fingers 14 and said arm 16 supports the target 55 as shown in FIG. 13. The target 55 is now ready to be launched.

To launch the target 55, said release 24 rotates said stop 23 by pulling on the bottom of said stop 23. When said stop 23 rotates out of the way, the target rotating arm 16 will rotate rapidly, launching the target. The spring loaded stabilizing fingers 12 will be pushed out of the way by the movement of the launch arm 16. Since the fingers 12 are spring supported, they will simply pop back up after the launch arm 16 moves over them. This completes one cycle and target thrower is in position to repeat the cycle.

The process is the same for launching two targets 55 except one would pull back sliding door 6 to uncover the second hole 57, shown in FIG. 10. This allows two targets to drop onto the target lowering assembly 13.

In the preferred embodiment of the present invention, the preferred structural materials are steel, although, as obvious to anyone skilled in the state of the art, other metals, such as aluminum would suffice for the intended purpose. The friction plate can be made from any number of common brake lining materials, either organic or metallic.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A target thrower comprising:

a) a base;

b) a target turret assembly;

c) a ratcheting assembly;

d) a target positioning component assembly further comprising spring loaded stabilizing fingers, a target lowering assembly, and temporary support fingers; and e) a target launching assembly further comprising a target launching arm;

wherein a motor assembly rotates a cam wheel which actuates the ratcheting assembly which rotates said turret assembly over the base, dropping at least one target on to said target lowering assembly which lowers said target, depositing said target on said temporary support fingers and said stabilizing fingers;

wherein said target lowering assembly continues to move downward, leaving said target supported soley by said temporary support fingers and said stabilizing fingers;

wherein said target throwing arm is being rotated into position to launch said target until said target throwing arm is stopped and held in position by a means of stopping and holding said target arm in position, said target throwing arm moving under said target, pushing down said temporary support fingers so said target throwing arm supports said target;

wherein said means of stopping and holding said target arm in position is released, permitting said target throwing arm to rotate rapidly, launching the target.

2. A target thrower comprising:

a) target holding means holding a plurality of targets;

b) ratchet means to release at least one target from said target holding means onto a target lowering assembly, said target lowering assembly supporting and lowering the at least one target;

c) a first and second finger means to receive said target from said target lowering assembly;

d) a target throwing arm for moving under said target and for moving said first finger means to a position wherein it no longer supports said target so that the target throwing arm at least partially supports said target prior to launching said target.

3. The target thrower of claim 2 wherein said target has a disc shape.

4. The target thrower of claim 2 wherein the target holding means includes a rotatable turret holding stacks of targets and wherein said turret is rotated by said ratchet means which includes a motor driven ratcheting assembly to release said target.

5. The target thrower of claim 4 wherein the rotatable turret can rotate in a clockwise or counter clockwise direction to dispense targets.

6. The target thrower of claim 2 wherein the second finger means includes a spring biased finger having a first position wherein said finger contacts and supports said target and a second position where it is moved out of contact with said target by said target throwing arm.

* * * * *